US010039426B1

(12) United States Patent
Soules

(10) Patent No.: US 10,039,426 B1
(45) Date of Patent: Aug. 7, 2018

(54) SYSTEM AND METHOD FOR DISPENSING PRODUCTS

(71) Applicant: Jack Soules, Las Cruces, NM (US)

(72) Inventor: Jack Soules, Las Cruces, NM (US)

( * ) Notice: Subject to any disclaimer, the term of this patent is extended or adjusted under 35 U.S.C. 154(b) by 0 days.

(21) Appl. No.: 15/428,491

(22) Filed: Feb. 9, 2017

(51) Int. Cl.
*A47K 10/42* (2006.01)

(52) U.S. Cl.
CPC ..... *A47K 10/422* (2013.01)

(58) Field of Classification Search
USPC ..... 221/45, 46, 49, 52, 61, 62
See application file for complete search history.

(56) References Cited

U.S. PATENT DOCUMENTS 1,650,945 A * 11/1927 Krueger ..... A47K 10/422 221/45
2,253,742 A 8/1941 West et al.
2,636,599 A 4/1953 Willis et al.
2,795,353 A * 6/1957 Tuttle ..... A47K 10/422 221/46
3,343,716 A * 9/1967 Peebles ..... B65D 83/0817 221/197
3,603,452 A 9/1971 Singer
3,942,682 A 3/1976 McKay
4,407,475 A * 10/1983 Gossage ..... A47B 37/04 108/116
4,997,105 A * 3/1991 Fischer ..... B65D 5/16 206/278
5,165,570 A 11/1992 Windorski et al.
5,197,631 A 3/1993 Mishima
5,265,758 A * 11/1993 Saint Criq ..... A47K 10/185 221/119
5,390,820 A 2/1995 Wright et al.
6,079,190 A 6/2000 Simpson
6,283,295 B1 9/2001 Akutagawa et al.
6,296,143 B1 * 10/2001 Ghabriel ..... A47K 10/421 221/34
6,648,172 B2 * 11/2003 Leighton ..... A47K 10/421 206/233
6,749,084 B2 6/2004 Thompson
7,178,689 B2 * 2/2007 Wieser ..... A47K 10/422 221/45
7,360,667 B2 4/2008 Stravitz
8,631,968 B2 * 1/2014 Taylor ..... A47K 10/422 221/36
9,451,851 B1 9/2016 Lukawski
2007/0235467 A1 10/2007 Heitmann
2010/0252475 A1 10/2010 Konuma

FOREIGN PATENT DOCUMENTS

WO 2001053169 A1 7/2001

* cited by examiner

*Primary Examiner* — Timothy R Waggoner
*Assistant Examiner* — Ayodeji T Ojofeitimi
(74) *Attorney, Agent, or Firm* — Kevin Soules; Luis M. Ortiz; Kermit D. Lopez

(57) ABSTRACT

A tissue dispenser comprises a base, at least one retaining strut connected to the base, and a dispensing pedestal. The tissue dispenser further comprises a box filled with tissue and an aperture in the bottom of the box, wherein the dispensing pedestal passes through the aperture in the bottom of the box holding the tissue at or near the top of the box.

20 Claims, 6 Drawing Sheets

SYSTEM AND METHOD FOR DISPENSING PRODUCTS

TECHNICAL FIELD

Embodiments are generally related to the field of product dispensers. Embodiments are also related to dispensing tissue. Embodiments additionally relate to methods and systems for improving tissue dispensers and tissue boxes.

BACKGROUND

Most people use tissues on a regular basis. Facial tissue, for example, can be used to wipe away unwanted material on a persons hands or face. Given the close contact between the tissue and human anatomy that is susceptible to the infiltration of harmful bacterial or other contaminants (i.e., a person's mouth and nose), it is desirable for the tissue to be substantially free of such contaminants; particularly those from other people.

Currently tissue boxes are configured to hold a stack of tissue with each tissue in the stack interleaved with the tissue immediately above and below. The tissue box has an opening at the top. When the box is full, the tissues generally are near the opening. The interleaving of the stack of tissues facilitates the removal of the top tissue. As one tissue is removed, it naturally pulls the next into place for dispensation through the opening at the top of the box.

However, as the box is emptied, the height of the next tissue relative to the opening in the top of the box decreases. As a result, those attempting to extract a tissue are forced to reach through the opening into the box and often fumble to retrieve a new tissue. Given that those using tissues are often suffering from some contagious ailment, fumbling inside the box for tissue often results in contamination of the other tissues in the box.

Accordingly, a need exists for improved systems and methods for dispensing products, such as tissue, that reduces the contamination of the products by ensuring each product in the box is easy to retrieve.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings and abstract as a whole.

It is, therefore, one aspect of the disclosed embodiments to provide a prodigy dispensing device.

It is another aspect the disclosed embodiments to provide an improved tissue-dispensing device.

It is another aspect of the disclosed embodiments to provide a tissue-dispensing device that holds the un-dispensed tissues at or near the top of a tissue box.

It is a further aspect of the disclosed embodiments to provide improved methods for tissue dispensing.

The aforementioned aspects and other objectives and advantages can now be achieved as described herein. A system and method for dispensing tissue comprises a base, at least one retaining strut connected to the base, and a dispensing pedestal. The tissue dispenser further comprises a box filled with tissue and an aperture in the bottom of the box, wherein the dispensing pedestal passes through the aperture in the bottom of the box holding the tissue at or near the top of the box.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention; serve to explain the principles of the present invention.

DETAILED DESCRIPTION

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. Accordingly, embodiments may, for example, take the form of hardware, software, firmware, or any combination thereof (other than software per se). The following detailed description is therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment, and the phrase "in another embodiment" as used herein does not necessarily refer to a different embodiment. It is intended, for example, that claimed subject matter include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a," "an," or "the,"

again, may be understood to convey a singular usage or to convey a plural usage, depending at least in part upon context. In addition, the term abased on may be understood as not necessarily intended to convey an exclusive set of factors and may, instead, allow for existence of additional factors not necessarily expressly described, again, depending at least in part on context.

Figure 1:
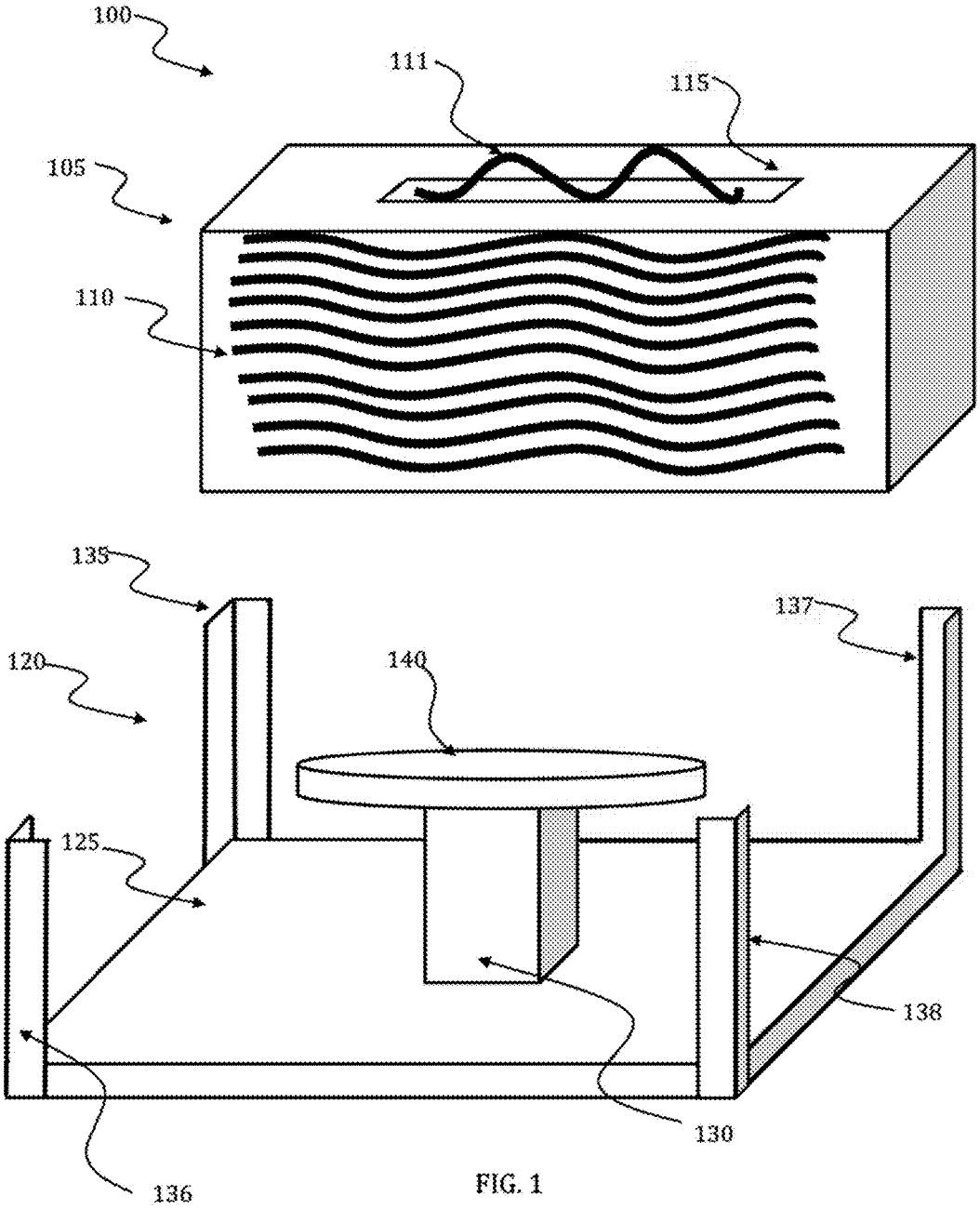
FIG. 1 illustrates a product dispensing system, in accordance with an embodiment.

According to the embodiments disclosed herein a system for distributing a product 100 is disclosed in FIG. 1. The system includes a dispensing apparatus 120 with a base structure 125 and with braces or retaining struts 135, 136, 137, and 138. Preferably the retaining struts 135, 136, 137, and 138 are configured on the corners of the base structure 125, but other locations of the retaining struts 135, 136, 137, and 138 are possible. Such alternatives can include any location along the edges of the base 125. The retaining struts 135-138 are preferably angle iron type metal struts. Alternatively, the retaining struts 135-138 can be plastic, wood, or other such material that can be configured to have an angle (preferably of 90 degrees) between two connected vertical sides. In the embodiments, where the retaining struts 135, 136, 137, and 138 are configured along a single edge of the base 125, they can be flat.

A dispensing pedestal 140 is further connected to the base 125 via column 130. The dispensing pedestal 140 is generally formed with a shape that can fit through an opening on a product carrying box 105. The pedestal 140 can be configured as an oval platform, but other shapes are also possible. The height of the column 130 can be dependent on the height of the associated product carrying box 105, and is preferably at least as tall as box 105 so that the last of product 110 is held just below, at, or above the top surface of box 105. The product carrying box 105 can thus be set over the dispensing pedestal 140, such that the dispensing pedestal is inside the box 105.

In an alternative embodiment, an extended version of the dispensing pedestal 140 can be used in place of the column 130. In such, an embodiment, the dispensing pedestal 140 is formed to be at least as tall as the box 105 so that the last of product 110 is held just below, at or above the top surface of box 105. The pedestal 140 is thus connected directly to the base 125.

Product carrying box 105 generally comprises a box configured to hold one or more products to be dispensed individually or in small groups. In a preferred embodiment, the box 105 comprises a tissue box and can be filled with product 110. In the case of a tissue box, the product 110 can comprise tissue. In general, the top most product 111 protrudes from the box 105 from top opening 115. A person in need of the product can simply pull the product 111 from the box 105.

For example, in the case of a tissue box, the top most product can comprise a top tissue 111 which is overlapped or partially interleaved with the next lower tissue in the box. The layering and/or interleaving is repeated for all the tissues 110 in the box 105. When the top tissue 111 is removed, the interleaving results in the next tissue being partially pulled out of opening 115. It should be appreciated that while this exemplary embodiment is related to tissue and tissue boxes, box 105 can be configured to dispense any product stacked, layered, and/or interleaved therein.

Figure 2:
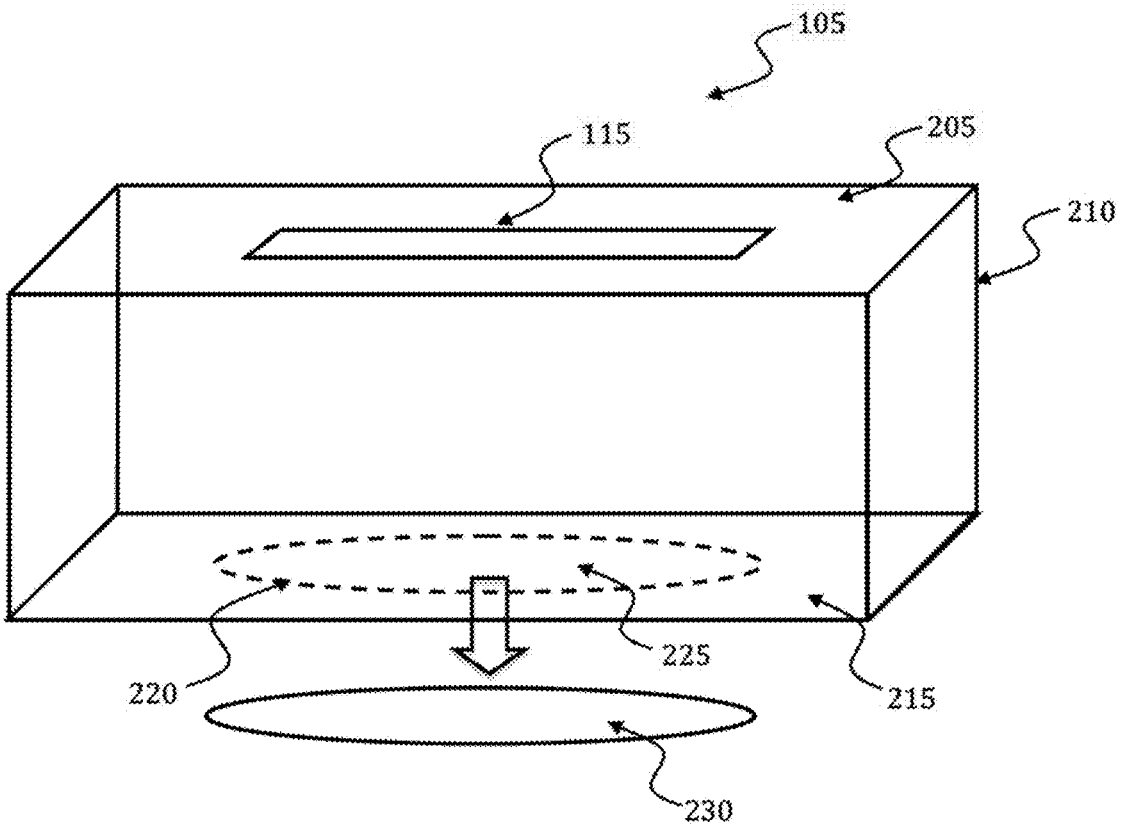
FIG. 2 illustrates a box for dispensing product, in accordance with an embodiment.

FIG. 2 illustrates an embodiment of box 105. In general, box 105 includes a dispensing opening 115 on the top surface 205 of the box 105. The box 105 includes sidewalls 210 and bottom surface 215. The bottom surface 215 can include a perforation 220. The perforation 220 facilitates the removal of a portion 230 of the bottom surface 215, resulting in aperture 225.

The shape and size of the aperture 225 can be configured to match, interface with, or otherwise accommodate the shape of pedestal 140. For example, in some embodiments, the pedestal 140 is oval shaped. In such embodiments, the perforation 220 in the bottom 215 of box 105 can also be an oval such that when the portion 230 is removed an oval shaped aperture 225 is left. Thus, the pedestal 140 can be inserted in the oval shaped aperture 225. It should be appreciated that these shapes are exemplary and other shapes might also be used.

In addition, in certain embodiments the size and/or shape, of the aperture 225 may not exactly match that of the pedestal 140. For example, in some embodiments it may be desirable for the length and/or width of the pedestal 140 to exceed the length of the aperture 225 so that the pedestal 140 is long enough to support product 110 in box 105 that exceeds the length and/or width of the aperture 225. In such cases, one side of the pedestal 140 can be inserted through aperture 225 and then the box 105 and/or whole system 120 can be manipulated to slide the pedestal 140 to one side of the box 105. At this point, the other side of the pedestal 140 can be inserted through the aperture 225 and then the box 105 and/or system 120 can be manipulated to re-center the pedestal 140 in the box 105. For example, in such an embodiment, the aperture 225 can be an oval, but the pedestal 140 can be an elongated rectangle. In this exemplary embodiment, the dimensions of the rectangle allow the pedestal 140 to fit through the oval shaped aperture 225 while supporting product that is longer and/or wider than the aperture 225.

Figure 3:
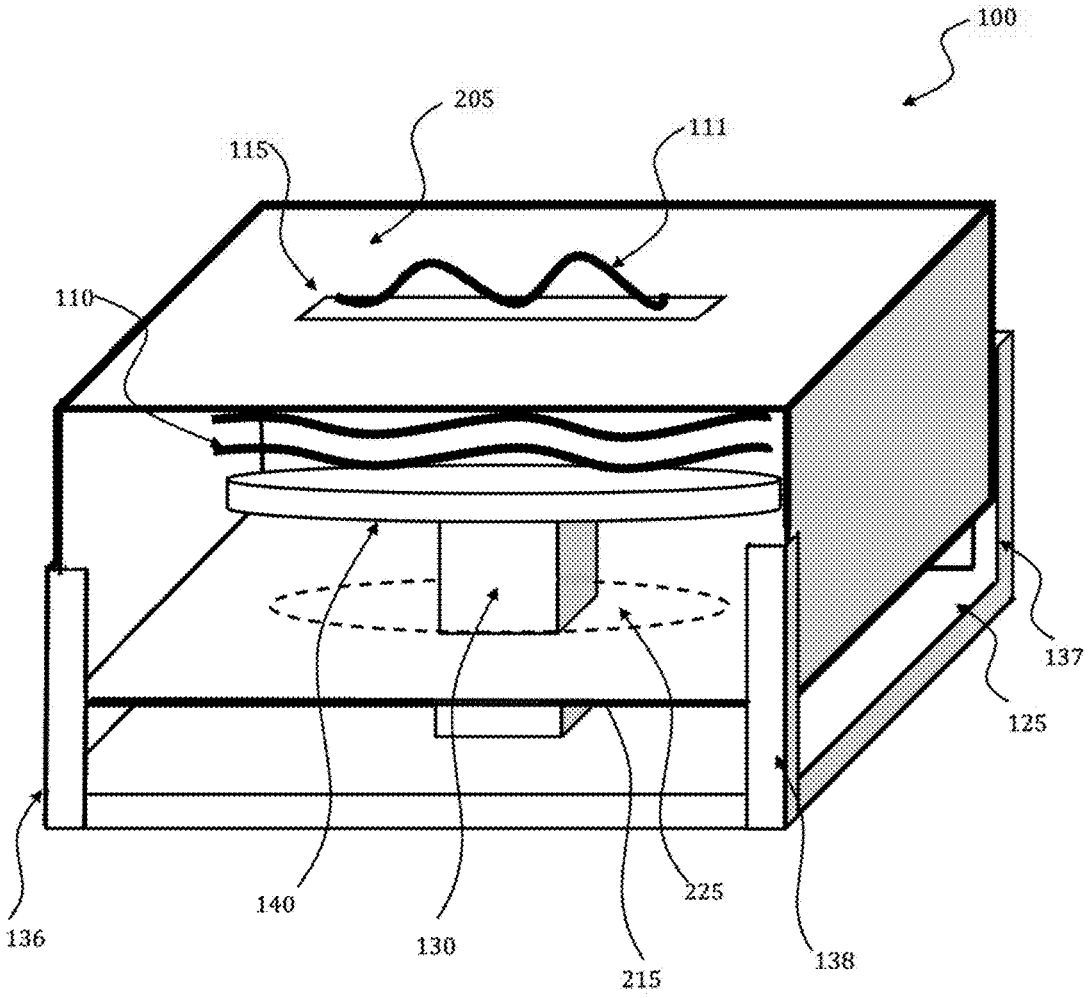
FIG. 3 illustrates a tissue dispensing system, in accordance with an embodiment.

Removal of the portion 230 thus facilitates insertion of dispensing pedestal 140 through aperture 225. As FIG. 3 illustrates, dispensing pedestal 140 exerts an upward force on product 110 as box 105 is pulled down around the pedestal 140 and the column 130 from gravity. When the top product 111 is removed from box 105, the height of the stack of product 110 decreases. However, the pedestal 140 holds the remaining product 110 at the top of the box 105 so that a new top product 111 is available at the top opening 115.

In an embodiment, the surface area of the bottom 215 of box 105 is sized to fit within the surface area of the base 105 of dispensing apparatus 120, and/or the dispensing apparatus 120 is sized to fit box 105. Retaining struts 135-138 are generally configured to hold box 105 in position over pedestal 140. The shape of the retaining struts 135-138 are configured to engage the edges of the box 105 as illustrated in FIG. 3. As the box 105 slides down due to the force of gravity, the pedestal 140 holds product 110 at the top of the box so that a user does not need to reach into the box to extract additional product.

Figure 4:
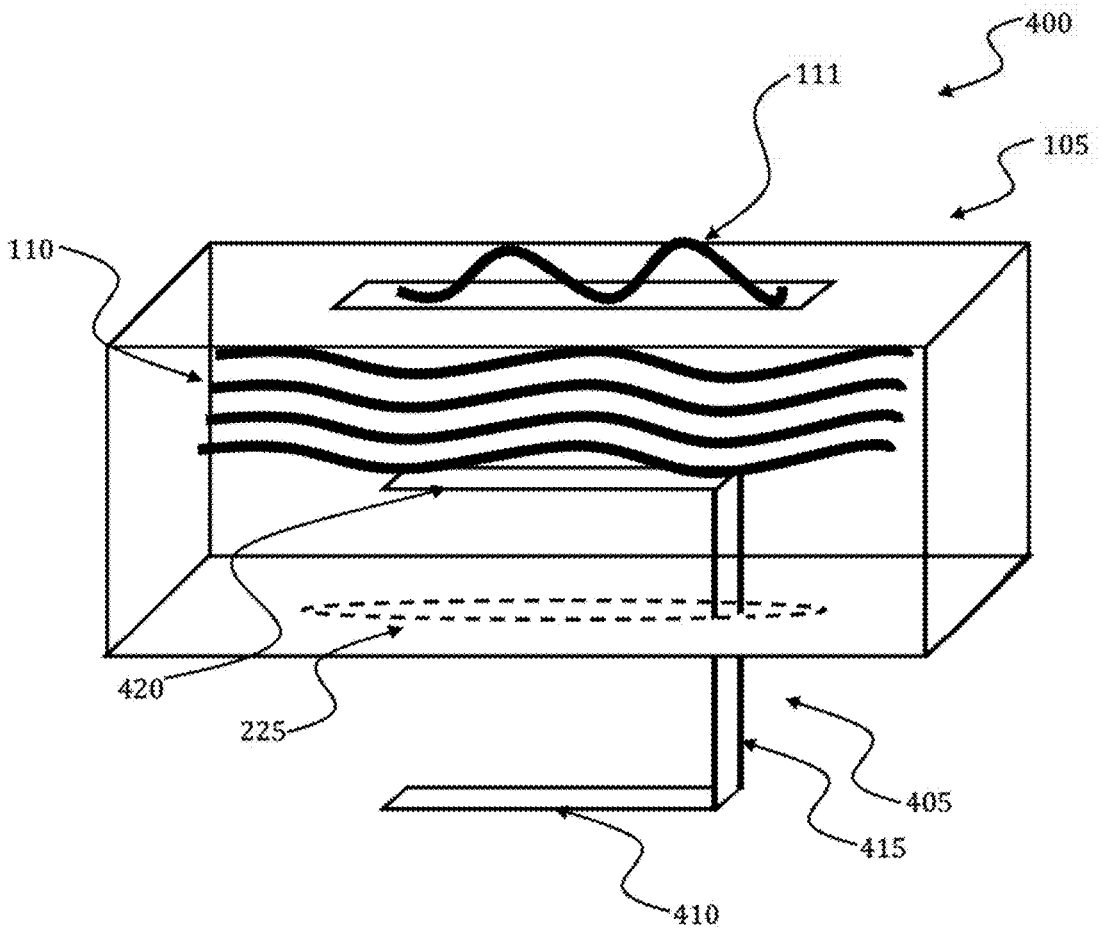
FIG. 4 illustrates an alternative embodiment of a product dispensing system, in accordance with an embodiment.

FIG. 4 illustrates an alternative embodiment of a product dispensing system 400. In this embodiment; a dispensing apparatus 405 can include a base 410 connected to a strut 415. The strut 415 supports a platform 420. The dispensing apparatus 405 can comprise a single piece of sheet metal with two bends. The bends are preferably 90 degree bends (although other bend angles are possible) such that the bends result in three sections: the base 410, the strut 415, and the platform 420.

The length of the base 410 can be equivalent to the length of the platform 420. However, in some embodiments, it may be desirable to make the base 410 shorter than the platform 420, so that the platform is long enough to support the product 110 in the box 105. For example, it may be necessary for the platform 420 to be long enough to support a substantial length of the product 110 (e.g., tissue stack) in the box 105 so that the ends of the product 110 do not sag around the platform 420. This ensures the top most tissue is easy to extract from the top of the box 105.

In other embodiments, the length and/or width of the base 410 can be longer than the platform 420. In such embodiments, the base 410 may need to be longer and/or wider to lend sufficient stability so that the product dispensing system 400 does not tip over.

Similarly, the thickness and width of the platform 420 can be selected to support the product 110 in the box 105. Likewise, the base 410 can have a thickness and/or width that are sufficient to support the box 105, with product 110 inside, without the box 105 tipping over. As such, the width and thicknesses of the platform 420 and base 410 can be selected according to design considerations.

The height of the strut 415 can be any height, but is preferably at least as tall as sidewall 210 of box 105 so that the last of product 110 is held just below, at, or above the top surface 205 of box 105.

In other embodiments, the dispensing apparatus 405 can be formed of wood, molded plastic, or metal. In the case of wood, the base 410, strut 415, and platform 420 can be joined by nails, screws, rivets, nuts and bolts, or other known jointing mechanisms. In the case of metal, the base 410, strut 415, and platform 420 can be joined with welds, epoxy, or via soldering.

As with other embodiments, the size and/or shape of the aperture 225 may not exactly match that of the platform 420. For example, in some embodiments, it may be desirable for the length of the platform 420 to exceed the length of the aperture 225 so that the platform 420 is long enough to support product 110 in the box 105 that exceeds the length of the aperture 225. In such an embodiment, the aperture 225 can be an oval, but the platform 420 might be, for example, an elongated rectangle such that the dimensions of the rectangle allow the rectangle to fit through the center of the oval shaped aperture 225, but not through the elongated sides of the rectangle. Other shapes of the platform 420 are also possible.

In an alternative embodiment, the aperture 225 can be a single lengthwise or broad-wise slit in the box 225. In such an embodiment, the slit can be sufficiently long to allow the width of the platform 420 and strut 415 to fit through the slit. The slit can be formed in the bottom surface 215 of box 105 as a perforation that can be separated in order to form the slit.

Figure 5:
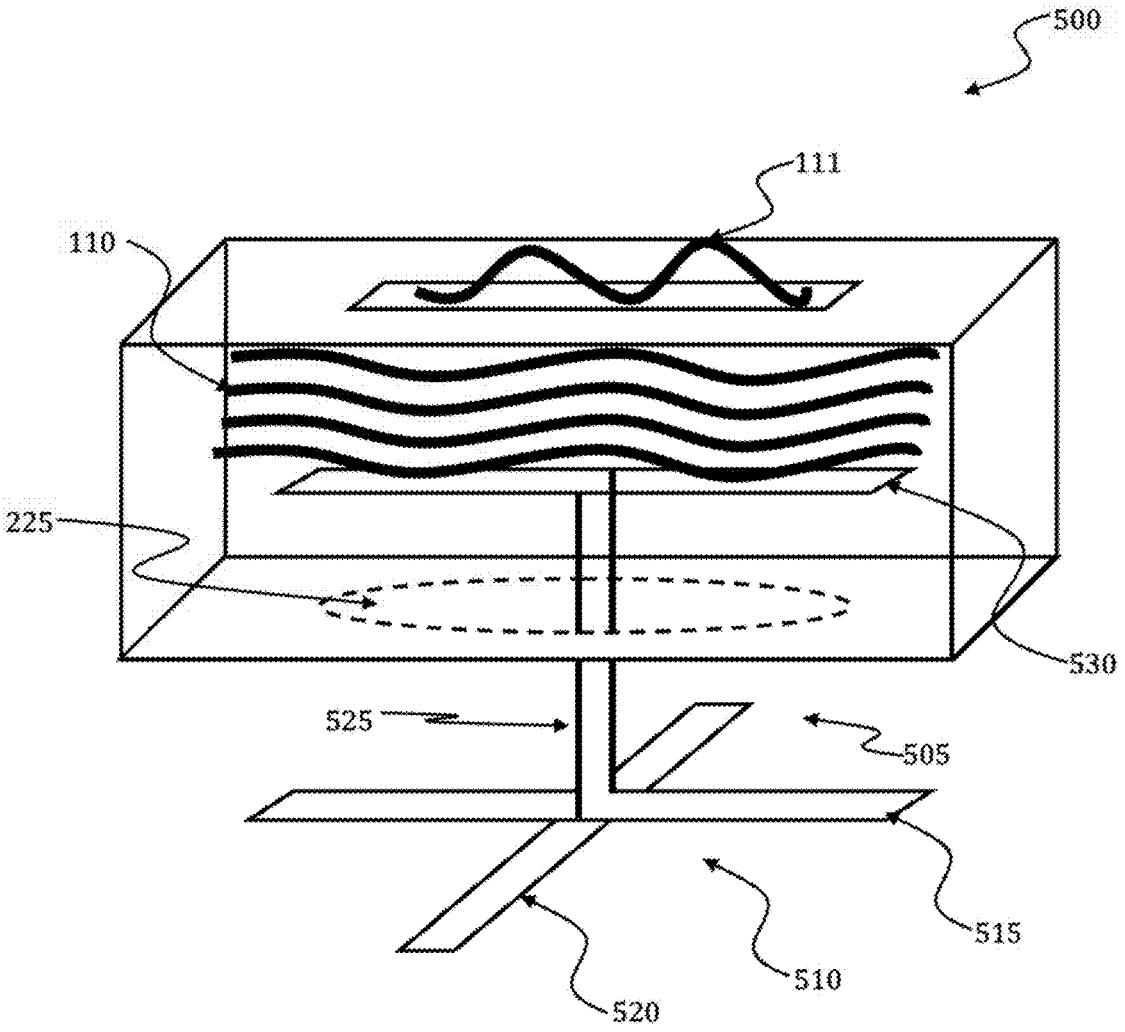
FIG. 5 illustrates an alternative embodiment of a product dispensing system, in accordance with an embodiment.

FIG. 5 illustrates yet another embodiment of a product dispensing system 500. A dispensing apparatus 505 includes a base 510 connected to a strut 525. The strut 525 supports a platform 530. The base 510 comprises two legs, leg 515 and leg 520 which are perpendicular to one another. The strut 525 can be configured at the intersection of leg 515 and 520, and is preferably 90 degree from the plane of the legs (although other angles are possible). The strut 525 can also alternatively be formed at other points on either of legs 520 or legs 515. The strut 525 intersects the platform 530 at the platforms center, supporting the platform and the product 110 resting thereon. The strut 525 can alternatively intersect the platform 530 at any other point along the platform 530.

The length of legs 515 and legs 520 can differ. In some embodiments, it may be desirable to make legs 520 shorter than legs 515 because the likelihood of tipping is low. In other embodiments, the length of legs 515 can be shorter, or in some embodiments the lengths of legs 515 and 520 can be equivalent. In these embodiments, the base 510 can be configured to lend sufficient stability so that the product dispensing system 500 does not tip over.

It is desirable for the platform 530 to be long enough to support a substantial length of the product (e.g., tissue) in the box 105 so that the ends of the tissue do not sag around the platform 530. As such, in certain embodiments, the length of platform 530 can be sized to be slightly shorter than the length of box 105. In such cases, one side of the platform 530 can be inserted through aperture 225 and then the box 105 and/or dispensing apparatus 505 can be manipulated to slide the platform 530 to one side of the box 105. At this point, the other side of the platform 530 can be inserted through the aperture 225 and then the box 105 and/or dispensing apparatus 505 can be manipulated to re-center the platform 530 and strut 525 in the box 105. In such an embodiment, the aperture 225 can be an oval, but the platform 530 can be, for example, an elongated rectangle. Other such shapes and sizes of the platform 530 and aperture 225 can also be used.

The thickness and width of the platform 530 can be selected to support the product 110 in the box 105. Likewise, the base 510, and by extension legs 515 and legs 520, can have a thickness and/or width that is sufficient to support the box 105, with product 110 inside, without the box 105 tipping. As such, the width and thicknesses of the platform 530 and base 510 can be selected according to design considerations.

The height of the strut 525 can be any height, but is preferably at least as tall as sidewall 210 of box 105 so that the last of product 110 is held just below, at, or above the top surface 205 of box 105.

The dispensing apparatus 500 can be formed of wood, molded plastic, or metal. In the case of wood, the base 510, strut 525, and platform 530 can be joined by nails, screws, rivets, nuts and bolts, glue, epoxy, or other known jointing mechanisms. In the case of metal, the base 510, strut 525, and platform 530 can be joined with welds, epoxy, or via soldering. The product dispensing system 500 can also be configured of a combination of such materials in some embodiments.

Figure 6:
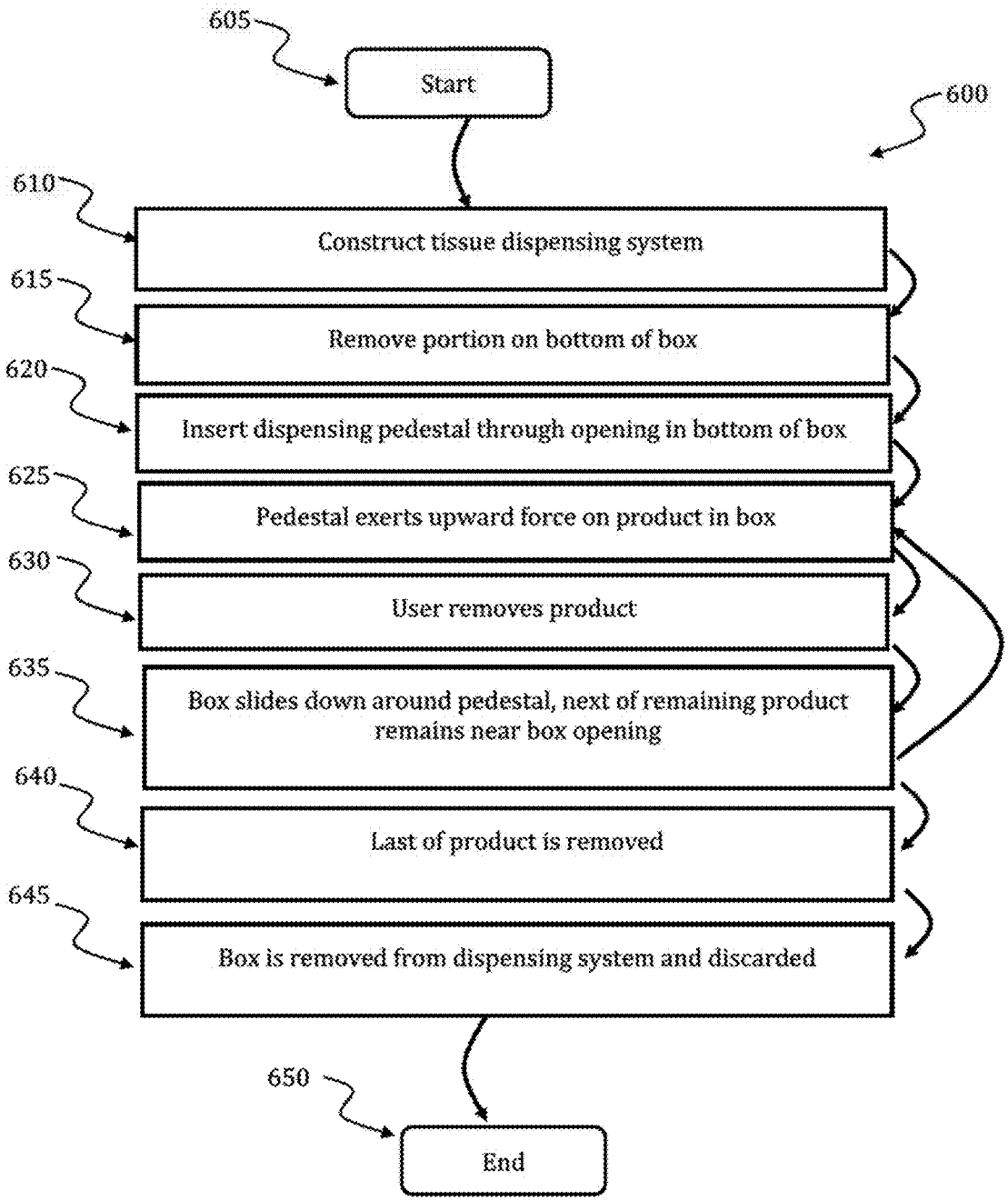
FIG. 6 illustrates a high level flow chart of method steps for dispensing product, in accordance with another embodiment.

FIG. 6 illustrates a method 600 for dispensing product from a box in accordance with the disclosed embodiments. The method begins at step 605. At step 610, a product dispensing system can be constructed. In an embodiment, the product dispensing system is configured as a product (e.g., tissue) dispensing system including a box filed with tissue and a removable portion of the bottom of the box. The system also includes a base with struts to hold the tissue box in place and a dispensing pedestal configured to fit in the opening in the bottom of the tissue box and hold the top most tissue in the box at or near the top of the box.

At step 615, the removable portion of the bottom of the box can be removed. Preferably, removal of the bottom portion of the box is facilitated by perforations in the bottom of the box. Removing the bottom portion of the box allows for the insertion of the dispensing pedestal through the opening as illustrated at step 620. The pedestal exerts upward force on the product (e.g., tissue) so that the product is held at or near the top of the box as shown at step 625.

At step 630, a user can remove the top most product from an opening in the top of the box. In the case of tissue, the tissue can be layered, partially layered, and/or interleaved such that the removal of the top tissue draws the next tissue through the opening in the top of the box. When the top tissue is removed from the box, the box necessarily slides down around the pedestal. This is a function of the removal of a tissue, which decreases the thickness of the remaining tissues stacked in the box. The pedestal holds the remaining tissue up near or against the top of the box as shown at step 635. In practice, this results in the top most of the remaining product staying at or near the top of the box, and prevents the need for a user to dig into the box to retrieve a new tissue as additional tissues are removed.

As illustrated, steps 625-635 can be repeated until the last of the product is removed from the box as shown at step 640. At this point, the empty box can be removed from the pedestal and discarded, recycled, or the like as illustrated at step 645. The method ends at step 650.

Based on the foregoing, it can be appreciated that a number of embodiments are disclosed herein, preferred and alternative. For example, in one embodiment, a dispenser comprises a base, at least one retaining strut connected to the base, and a dispensing pedestal. In an embodiment, the dispenser further comprises a box filled with a product, an aperture in a bottom of the box, wherein the dispensing pedestal passes through the aperture in the bottom of the box holding the product.

In an embodiment, the box further comprises: a perforation along the bottom of the box wherein the perforation can be separated to create the aperture; and an aperture in a top of the box for dispensing the product. In an embodiment, the product comprises tissue. In an embodiment, the box comprises a tissue box.

In an embodiment, the dispenser further comprises a column connecting the base to the dispensing pedestal. In another embodiment, a height of the dispensing pedestal relative to the base matches or exceeds a height of the box. In yet another embodiment of the dispenser, a bottom surface of the box has a smaller surface area than a surface area of the base.

In another embodiment, a dispensing system comprises a base, at least one retaining strut connected to the base, and a dispensing pedestal. The dispensing system further comprises a box filled with a product; and an aperture in a bottom of the box, wherein the dispensing pedestal passes through the aperture in the bottom of the box holding the product.

In another embodiment, the box further comprises a perforation along the bottom of the box wherein the perforation can be separated to create the aperture and an aperture in a top of the box for dispensing the product. In an embodiment, the product comprises tissue. In another embodiment, the box comprises a tissue box.

In an embodiment, the dispensing system further comprises a column connected to the base and connected to the dispensing pedestal. In an embodiment, a height of the dispensing pedestal relative to the base matches or exceeds a height of the box. In another embodiment, a bottom surface of the box has a smaller surface area than a surface area of the base.

In another embodiment, a tissue dispensing system comprises a base, at least one retaining strut connected to the base, a dispensing pedestal, a tissue box filled with at least one tissue, and an aperture in a bottom of the tissue box, wherein the dispensing pedestal passes through the aperture in the bottom of the box holding the product.

In an embodiment, the tissue box further comprises a perforation in the bottom of the tissue box wherein the perforation can be separated to create the aperture. In an embodiment, the tissue box further comprises a column connecting the dispensing pedestal to the base. In yet another embodiment of the tissue dispensing system, a height of the dispensing pedestal relative to the base matches or exceeds a height of the tissue box.

It will be appreciated that variations of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A dispenser comprising:
a base;
at least one retaining strut connected to said base;
an oval shaped dispensing pedestal; and
a column connecting said base to said oval shaped dispensing pedestal wherein said oval shaped dispensing pedestal has a larger surface area than said column.

2. The dispenser of claim 1 further comprising:
a box filled with a product; and
an aperture in a bottom of said box, said aperture formed to match a shape of said oval shaped dispensing pedestal, wherein said oval shaped dispensing pedestal passes through said aperture in said bottom of said box holding said product.

3. The dispenser of claim 2 wherein said box further comprises:
a perforation along said bottom of said box wherein said perforation can be separated to create said aperture; and
an aperture in a top of said box for dispensing said product.

4. The dispenser of claim 2 wherein said product comprises tissue.

5. The dispenser of claim 2 wherein said box comprises a tissue box.

6. The dispenser of claim 2 wherein said at least one retaining strut comprises four independent retaining struts.

7. The dispenser of claim 5 wherein a height of said dispensing pedestal relative to said base matches or exceeds a height of said box.

8. The dispenser of claim 2 wherein said aperture in the bottom of said box is smaller than said pedestal.

9. A dispensing system comprising:
a base;
four independent retaining struts connected to said base;
an oval shaped dispensing pedestal; and
a column connecting said base to said oval shaped dispensing pedestal wherein said oval shaped dispensing pedestal has a larger surface area than said column.

10. The dispensing system of claim 9 further comprising:
a box filled with a product; and
an aperture in a bottom of said box, said aperture formed to match a shape of said oval shaped dispensing pedestal, wherein said oval shaped dispensing pedestal passes through said aperture in said bottom of said box holding said product.

11. The dispensing system of claim 10 wherein said box further comprises:
a perforation along said bottom of said box wherein said perforation can be separated to create said aperture; and
an aperture in a top of said box for dispensing said product.

12. The dispensing system of claim 10 wherein said product comprises tissue.

13. The dispensing system of claim 10 wherein said box comprises a tissue box.

14. The dispensing system of claim 10 wherein said base further comprises two crossing legs.

15. The dispensing system of claim 14 wherein a height of said dispensing pedestal relative to said base matches or exceeds a height of said box.

16. The dispensing system of claim 10 wherein said aperture in the bottom of said box is smaller than said pedestal.

17. A tissue dispensing system, said system comprising:

a base;

at least one retaining strut connected to said base;

an oval shaped dispensing pedestal;

a column connecting said base to said oval shaped dispensing pedestal wherein said oval shaped dispensing pedestal has larger surface area than said column;

a tissue box filled with at least one tissue; and an aperture in a bottom of said tissue box, wherein said dispensing pedestal passes through said aperture in said bottom of said box holding said at least one tissue.

18. The tissue dispensing system of claim 17 wherein said tissue box, further comprises:

a perforation in said bottom of said tissue box wherein said perforation can be separated to create said aperture.

19. The tissue dispensing system of claim 17 wherein said at least one retaining strut comprises four independent retaining strut.

20. The tissue dispensing system of claim 17 wherein a height of said dispensing pedestal relative to said base matches or exceeds a height of said tissue box.

* * * * *